US010465456B2

(12) United States Patent
Gupta et al.

(10) Patent No.: US 10,465,456 B2
(45) Date of Patent: Nov. 5, 2019

(54) GROUND HANDLING SYSTEM

(71) Applicant: Nabors Drilling Technologies USA, Inc., Houston, TX (US)

(72) Inventors: Ashish Gupta, Houston, TX (US); Derek Patterson, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 15/794,889

(22) Filed: Oct. 26, 2017

(65) Prior Publication Data

US 2018/0128065 A1 May 10, 2018

Related U.S. Application Data

(60) Provisional application No. 62/417,878, filed on Nov. 4, 2016.

(51) Int. Cl.
*E21B 19/15* (2006.01)

(52) U.S. Cl.
CPC ..... *E21B 19/15* (2013.01)

(58) Field of Classification Search
CPC ..... E21B 19/15; E21B 19/14; E21B 19/20
USPC ..... 414/22.51–22.71, 745.1–746.8
See application file for complete search history.

(56) References Cited

U.S. PATENT DOCUMENTS

| | | | | |
|---|---|---|---|---|
| 3,127,829 | A * | 4/1964 | Rossi | B65B 27/10 100/4 |
| 3,971,442 | A * | 7/1976 | Scott | E21B 17/006 166/380 |
| 2010/0163247 | A1* | 7/2010 | Wright | E21B 19/155 166/380 |
| 2012/0219396 | A1* | 8/2012 | Schopf | B23K 26/38 414/745.1 |
| 2014/0093347 | A1* | 4/2014 | Thomas | E21B 37/00 414/800 |
| 2014/0093348 | A1* | 4/2014 | Thomas | E21B 37/00 414/800 |
| 2014/0110173 | A1* | 4/2014 | Belik | E21B 17/006 175/52 |
| 2015/0183590 | A1* | 7/2015 | Yu | B65G 47/248 414/773 |
| 2017/0096867 | A1* | 4/2017 | Folk | E21B 19/155 |
| 2018/0195352 | A1* | 7/2018 | Koehler | E21B 19/15 |

* cited by examiner

*Primary Examiner* — Lynn E Schwenning
(74) *Attorney, Agent, or Firm* — Adolph Locklar

(57) ABSTRACT

A ground handling system includes a main skid. The main skid has a main skid frame that includes a main tubular handling cradle. The main skid also includes a catwalk mechanically coupled to the main skid frame. In addition, the ground handling system includes a secondary skid mechanically coupled to the main skid. The second skid includes a second skid frame that includes a second tubular handling cradle. The second skid also includes a second catwalk mechanically coupled to the secondary skid frame. Tubulars may be transferred from the second tubular handling cradle to the main tubular handling cradle. The main skid further may include a pipe treatment carriage slidably coupled to the main skid frame and supporting one or more of a cleaning canister, doping canister, roller clamp, or tire clamp.

20 Claims, 22 Drawing Sheets

GROUND HANDLING SYSTEM

CROSS-REFERENCE TO RELATED APPLICATIONS

This application is a nonprovisional application that claims priority from U.S. provisional application No. 62/417,878, filed Nov. 4, 2016.

TECHNICAL FIELD/FIELD OF THE DISCLOSURE

The present disclosure relates generally to drilling equipment, and specifically to tubular handling equipment.

BACKGROUND OF THE DISCLOSURE

When forming a wellbore, one or more tubular strings may be introduced in the wellbore using a drilling rig. The tubular strings may include a drill string used to drill the wellbore, a casing string used to case the wellbore, or other tool strings. Each string is made up of a series of tubular members joined end-to-end to form a continuous tubular string. Typically, the tubular members are joined using a threaded connection made up as an additional tubular member is added to the existing string. Tubular members are transported to the drilling rig by truck in a horizontal orientation and are positioned on a ground handling system which typically includes a catwalk and ramp leading to the drilling rig. However, where a single catwalk is used, tubulars may need to be removed when switching the type of tubular members being utilized. For example, if introducing casing into the wellbore, drill pipe may need to be removed from the catwalk to allow casing tubulars to be introduced to the drilling rig.

SUMMARY

The present disclosure includes a ground handling system. The ground handling system includes a main skid. The main skid has a main skid frame, the main skid frame including a main tubular handling cradle. The main skin also includes a catwalk, the catwalk mechanically coupled to the main skid frame. In addition, the ground handling system includes a secondary skid, the secondary skid mechanically coupled to the main skid. The secondary skid includes a secondary skid frame, the secondary skid frame including a tubular handling cradle. The second skid also includes a secondary catwalk, the secondary catwalk mechanically coupled to the secondary skid frame.

The present disclosure also provides a method. The method includes providing a ground handling system that includes a main skid. The main skid includes a main skid frame that includes a main tubular handling cradle. The main skid also includes a main catwalk mechanically coupled to the main skid frame. The ground handling system also includes a secondary skid mechanically coupled to the main skid. The secondary skid includes a secondary skid frame that includes a secondary tubular handling cradle. In addition, the secondary skid includes a secondary catwalk, the secondary catwalk mechanically coupled to the secondary skid frame. The method also includes positioning one or more tubular members on the catwalk and transferring a first tubular member from the catwalk to the tubular handling cradle. The method may further include transferring a second tubular member from the secondary catwalk to the secondary tubular handling cradle and transferring the second tubular member from the secondary tubular handling cradle to the main tubular handling cradle.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
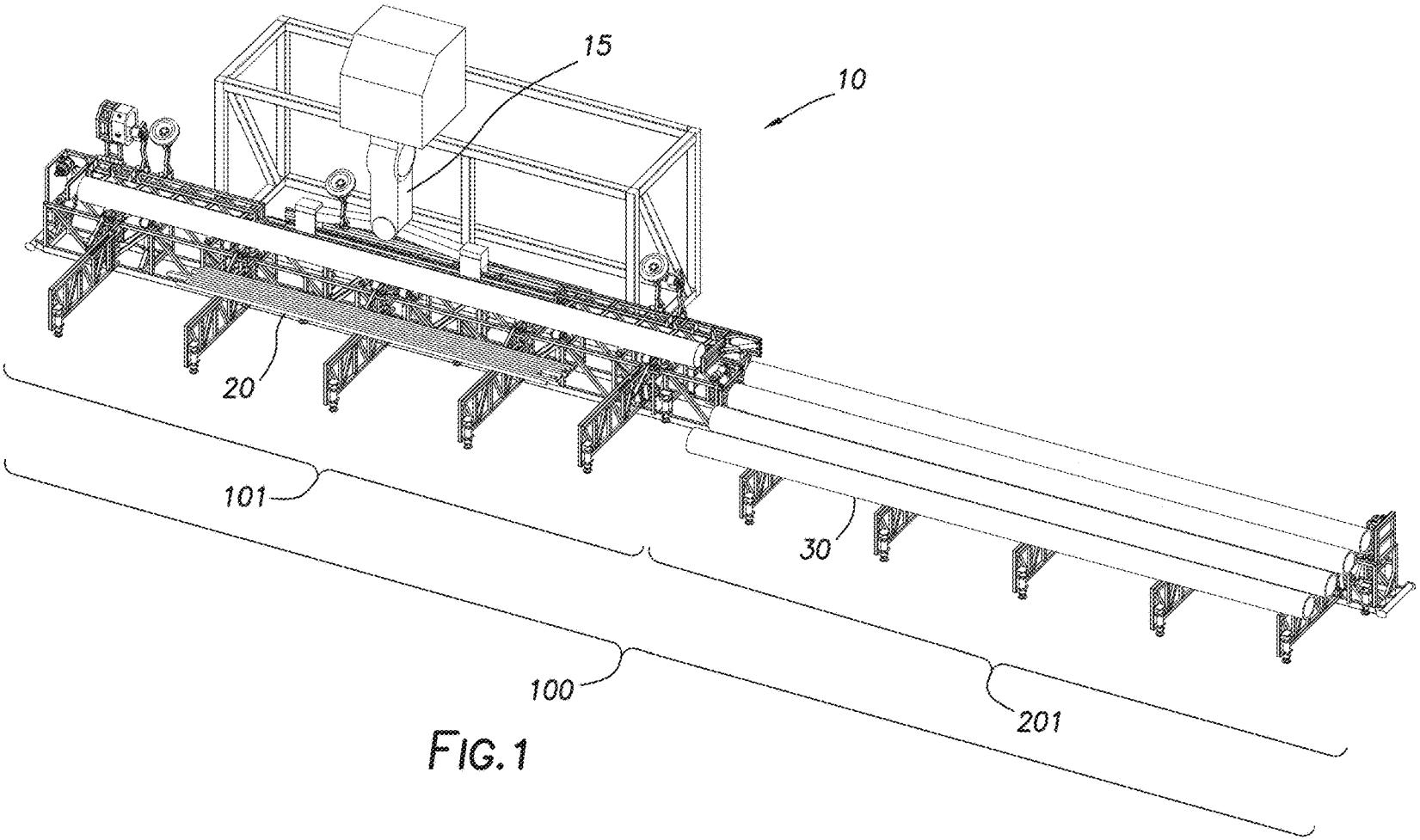
FIG. 1 depicts a perspective view of a ground handling system consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a ground handling system 100. Ground handling system 100 may be positioned proximate drilling rig 10. Drilling rig 10 may include pipe handler 15, adapted to receive tubular members from ground handling system 100 as discussed herein below. As shown in the accompanying figures, tubular members are depicted as drill pipe 20 and casing segment 30. However, one having ordinary skill in the art with the benefit of this disclosure will understand that any tubular members for use in a wellbore may be utilized with ground handling system 100 without deviating from the scope of this disclosure.

In some embodiments, ground handling system 100 may include main skid 101 and secondary skid 201. In the exemplary embodiments and description herein, main skid 101 is discussed as being utilized for drill pipe 20 and secondary skid 201 is discussed as being utilized for casing segment 30. However, both main skid 101 and secondary skid 201 may be used for either drill pipe 20, casing segment 30, or any other tubular members for use in a wellbore without deviating from the scope of this disclosure.

Figure 2:
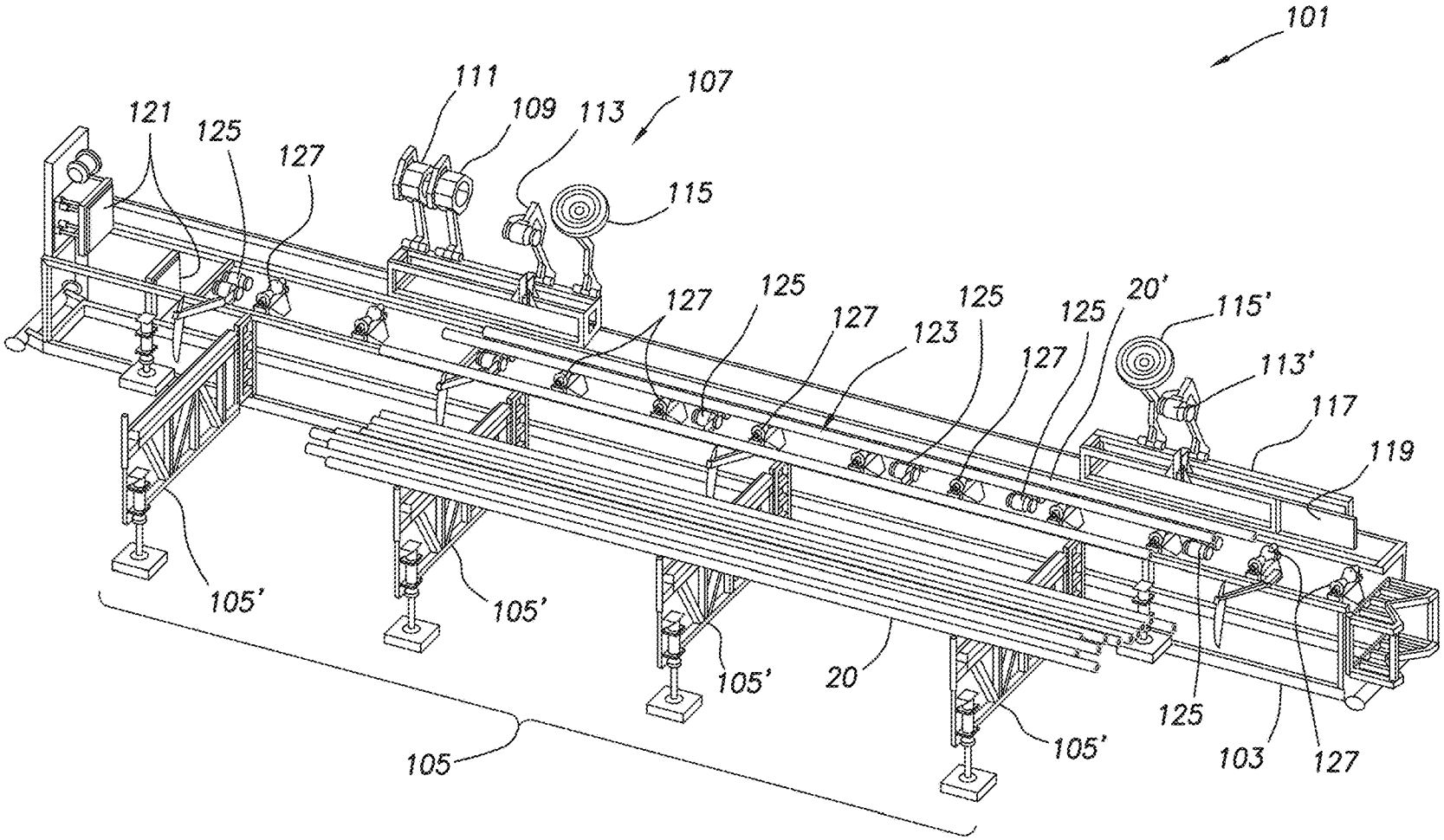
FIG. 2 depicts a perspective view of the main skid of FIG. 1.

As depicted in FIG. 2, main skid 101 may include a main skid frame 103 and a catwalk 105. Catwalk 105 may be used to support horizontally positioned tubular members for storage prior to introduction into drilling rig 10, depicted in FIG. 2 as drill pipe 20. Catwalk 105 may, in some embodiments, be made up of one or more separate catwalk segments 105' that may, in some embodiments, pivotably couple to main skid frame 103.

In some embodiments, main skid 101 may include a pipe treatment carriage 107. Pipe treatment carriage 107 may include one or more of cleaning canister 109, doping canister 111, roller clamp 113, and tire clamp 115. Although described separately herein, cleaning canister 109 and doping canister 111 may be included as part of a single canister. In some embodiments, main skid 101 may include a positioning carriage 117. Positioning carriage 117 may include one or more of roller clamp 113', tire clamp 115', and positioning plate 119. Pipe treatment carriage 107 and positioning carriage 117 may be slidably coupled to main skid frame 103 as discussed further herein below. Main skid 101 may further include a measurement plate 121. In some embodiments, measurement plate 121 may be positioned on pipe treatment carriage 107

In some embodiments, drill pipe 20 positioned on catwalk 105 may be introduced into a tubular handling cradle 123 positioned on main skid frame 103. Tubular handling cradle 123 may include one or more spinner rollers 125 positioned to rotate or allow drill pipe 20 to be rotated within tubular handling cradle 123. One or more of spinner rollers 125 may be powered to cause rotation of drill pipe 20. In some embodiments, tubular handling cradle 123 may include one or more rollers for moving drill pipe 20 longitudinally within tubular handling cradle 123 such as V-rollers 127. In some embodiments, one or more of V-rollers, conveyor belts, rollers, chain systems, or rack and pinion systems may be used to move drill pipe 20 longitudinally within tubular handling cradle 123. In some embodiments, one or both of spinner rollers 125 and V-rollers 127 may be retractable into and out of engagement with drill pipe 20 within tubular handling cradle 123. In some embodiments, one or both of spinner rollers 125 and V-rollers 127 may be retractable by, for example and without limitation, one or more hydraulic cylinders. In some embodiments, one or more of spinner rollers 125 and V-rollers 127 may be powered by, for example and without limitation, one or more of electric motors, hydraulic motors, or pneumatic motors.

Figure 3:
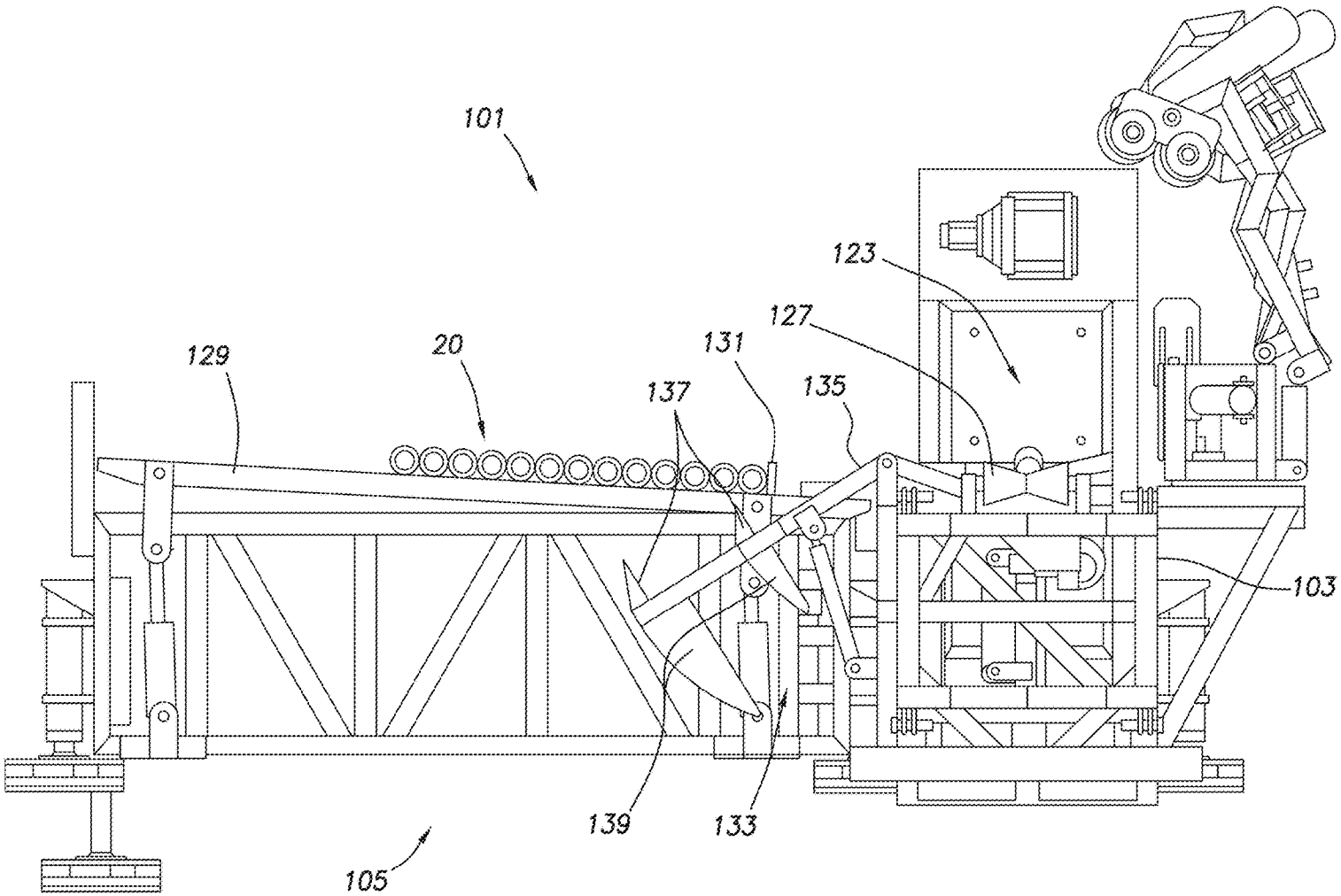
FIGS. 3-5 depict end views of the main skid of FIG. 2.
Figure 4:
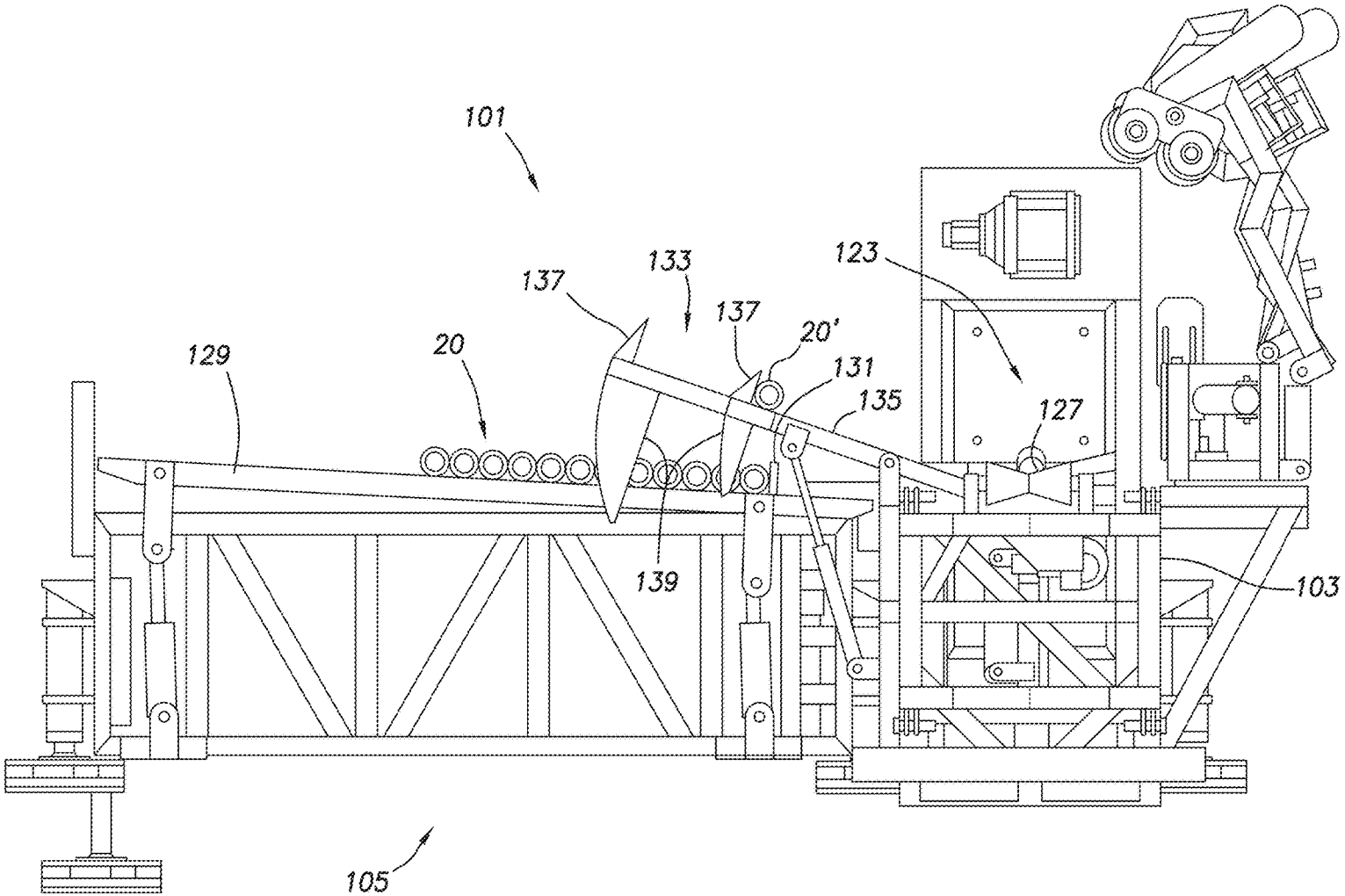
Figure 5:
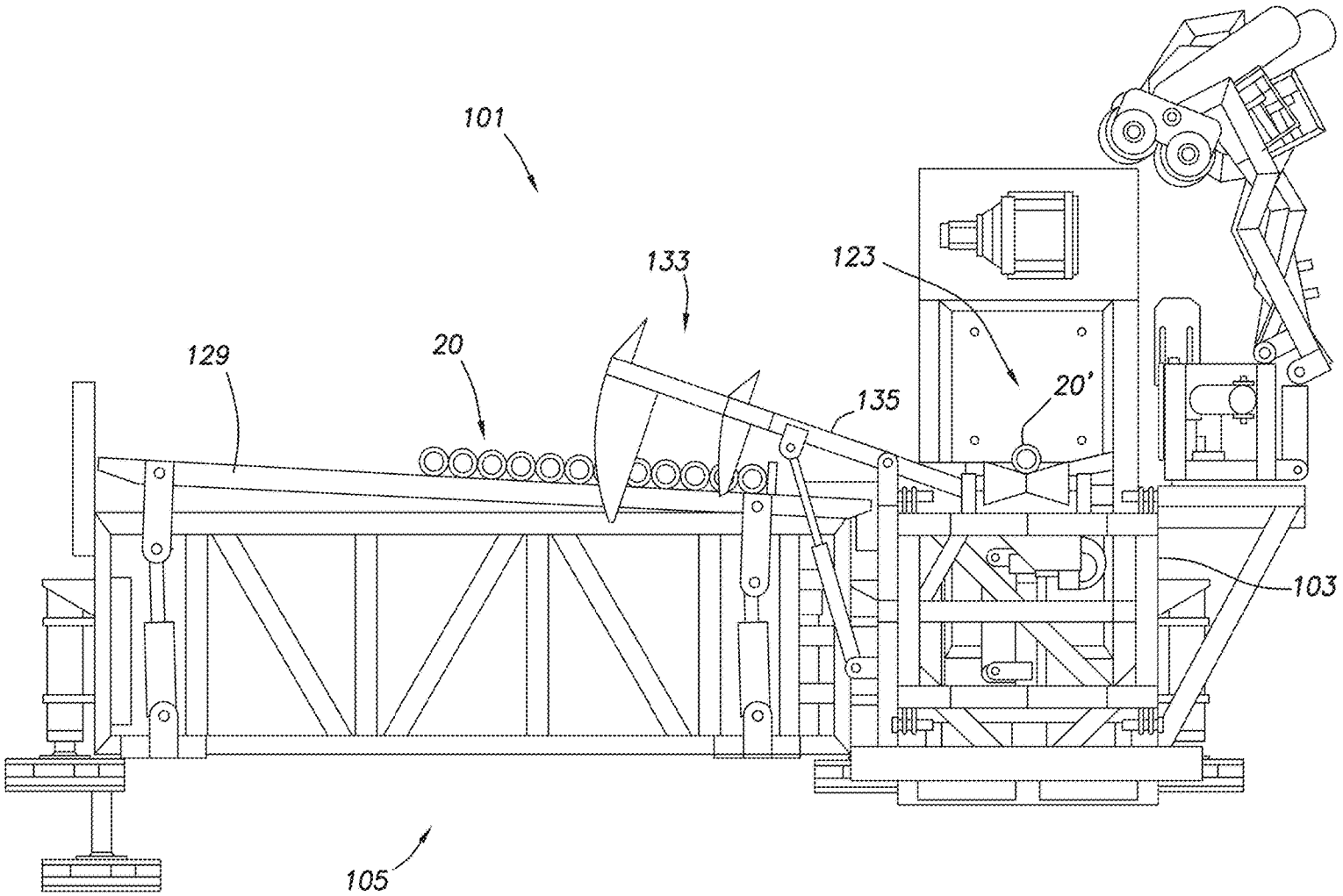

As depicted in FIGS. 3-5, multiple lengths of drill pipe 20 may be positioned on catwalk 105 in a horizontal configuration for, for example and without limitation, storage prior to introduction to drilling rig 10. In some embodiments, the lengths of drill pipe 20 may be positioned atop a storage rail 129. Storage rail 129 may, in some embodiments, be at an angle such that drill pipe 20 positioned thereon is biased by gravity toward main skid frame 103. In some embodiments, storage rail 129 may be coupled to catwalk 105 such that the angle of storage rail 129 may be modified or actuated to tilt. In some embodiments, catwalk 105 may include stop rail 131. Stop rail 131 may prevent drill pipe 20 from rolling into tubular handling cradle 123. In some embodiments, stop rail 131 may be repositionable to, for example and without limitation, accommodate different sizes or configurations of drill pipe 20 or other tubulars.

In some embodiments, individual lengths of drill pipe 20 may be loaded into tubular handling cradle 123 from catwalk 105 by one or more indexers 133. Indexers 133 may be pivotably coupled to main skid frame 103. Indexers 133 may include transfer rail 135, separators 137, and stoppers 139. In some embodiments, multiple indexers 133 may be included having configurations intended for use with different tubular members, such as drill pipe 20 or casing segment 30.

In an indexing operation, indexers 133 may be pivoted upward from the home position depicted in FIG. 3 to a raised position as depicted in FIG. 4. As indexers 133 raise, separators 137 separate the tubular member closest to tubular handling cradle 123 (here depicted as drill pipe 20') from any remaining drill pipe 20 on catwalk 105. At the same time, stoppers 139 may prevent the rest of drill pipe 20 from rolling against stop rail 131. Drill pipe 20', now positioned on transfer rail 135, may roll along the inclined transfer rail 135 into tubular handling cradle 123 as depicted in FIG. 5. Indexers 133 may then be lowered to the home position, allowing the next tubular member to roll up to stop rail 131 for the next indexing operation.

Figure 6:
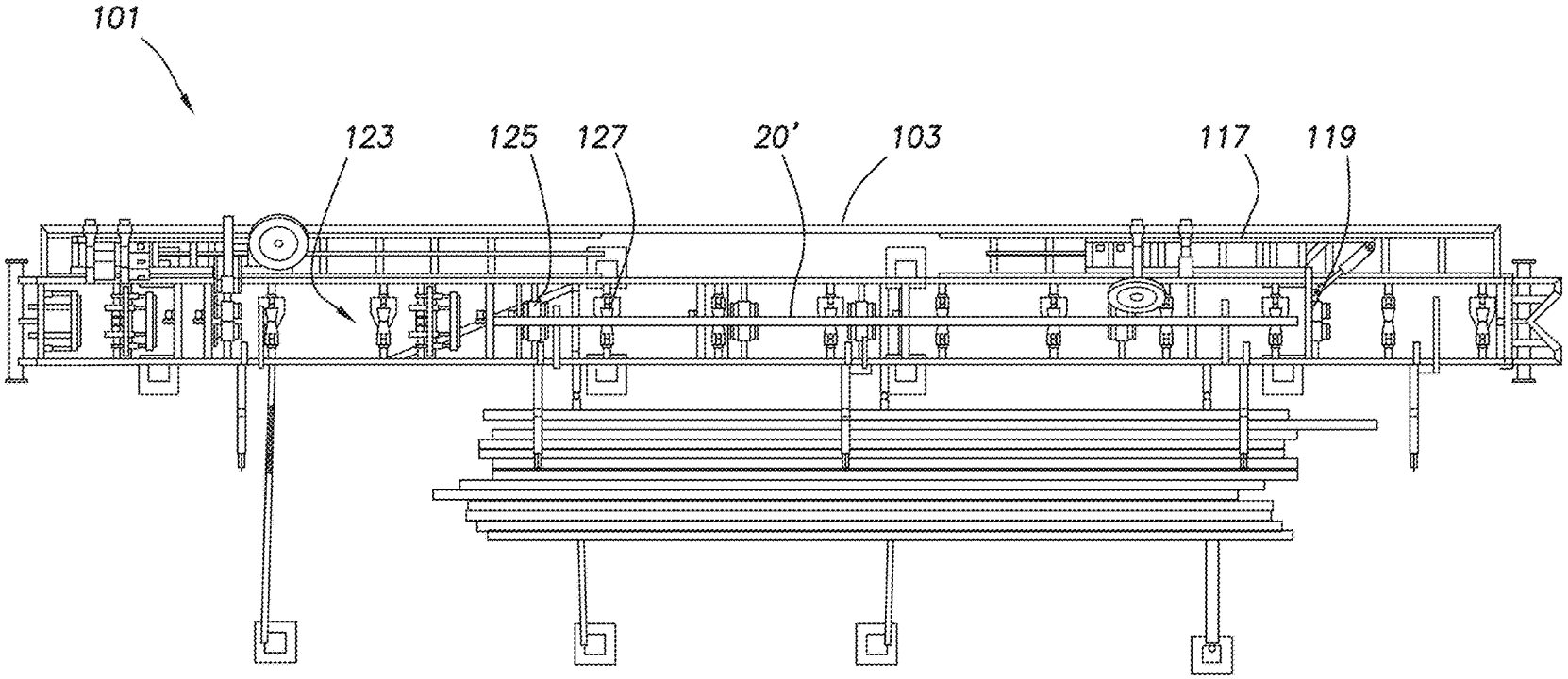
FIG. 6 depicts a top view of the main skid of FIG. 2.
Figure 7:
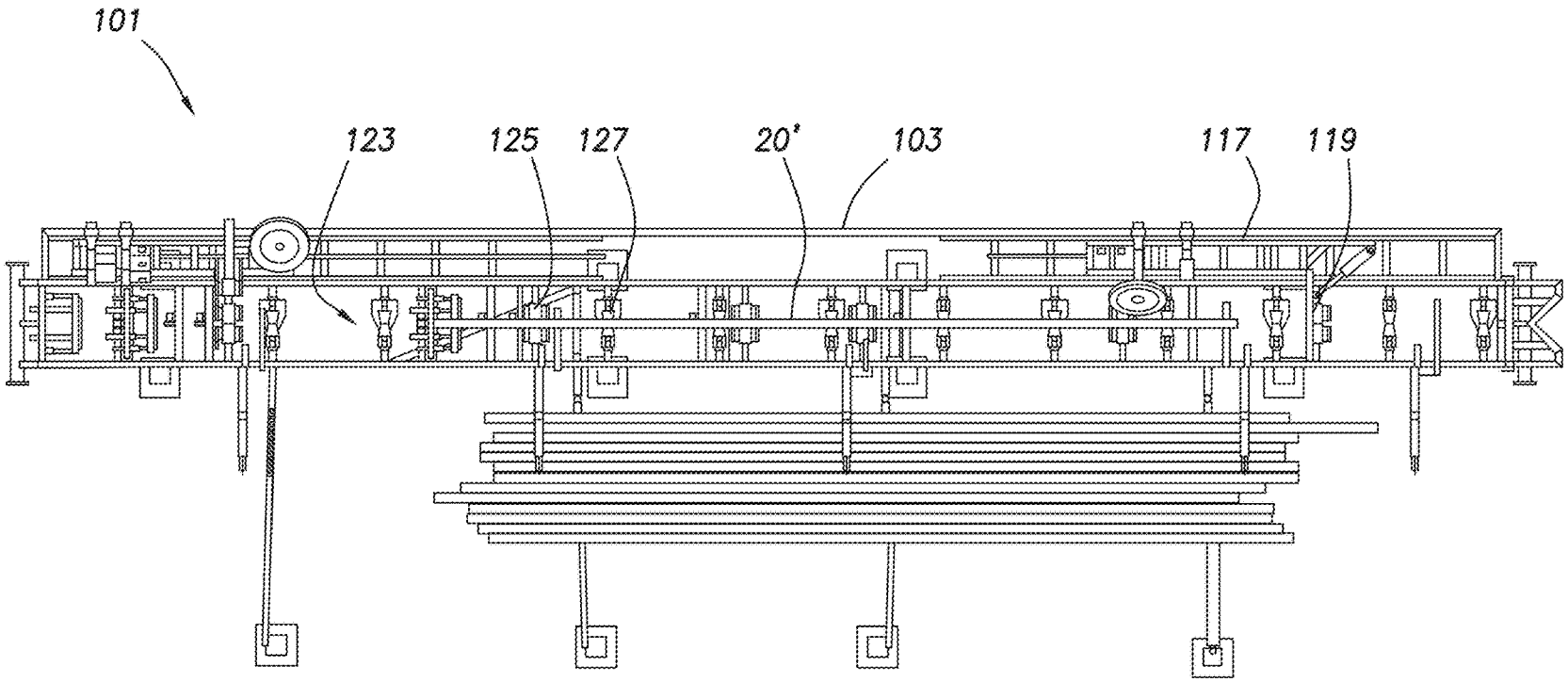
FIG. 7 depicts a top view of the main skid of FIG. 2.
Figure 8:
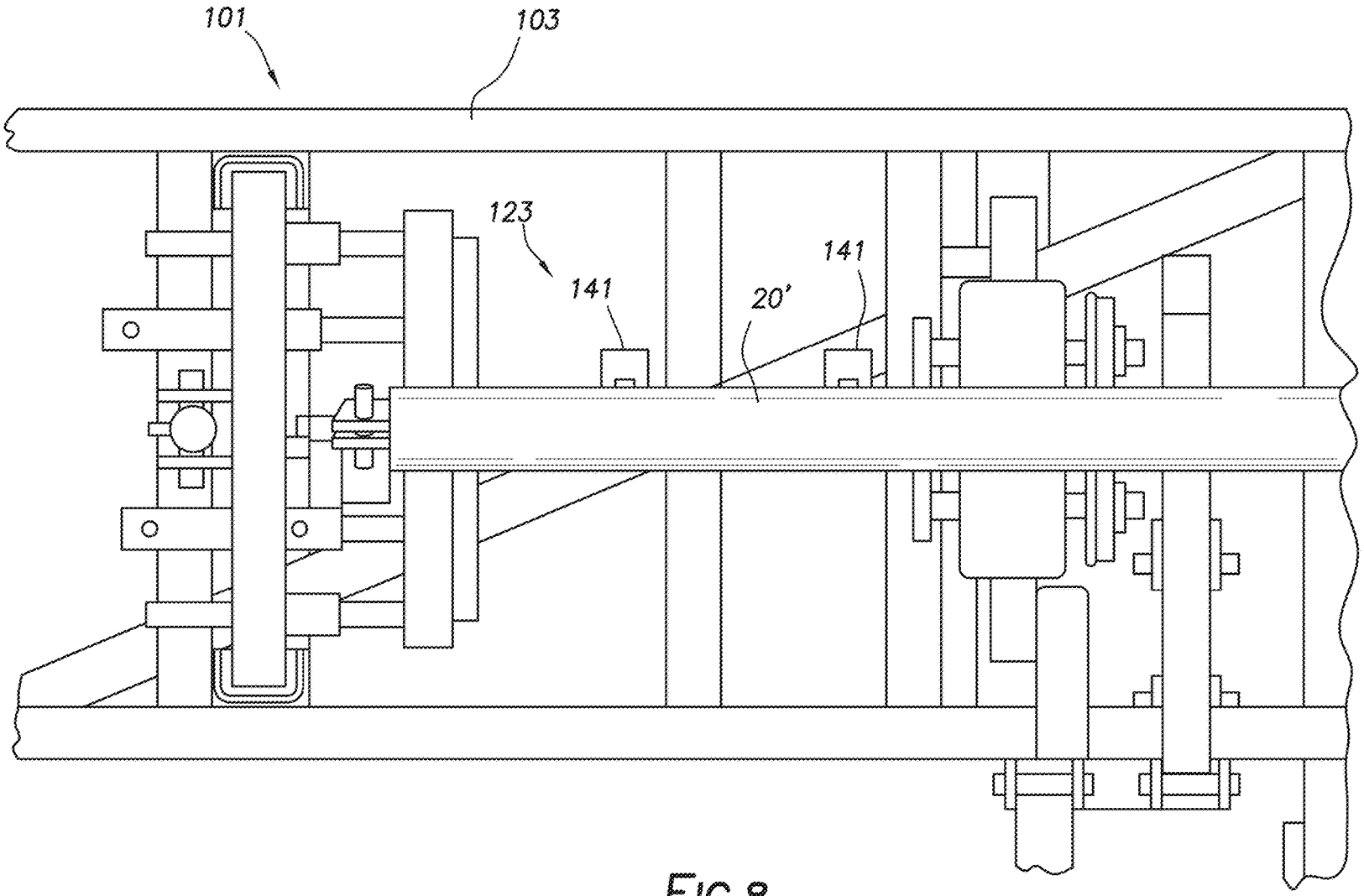
FIG. 8 depicts a detail view of the main skid of FIG. 2.

Once drill pipe 20' is positioned in tubular handling cradle 123 as depicted in FIG. 6, drill pipe 20' may be supported by one or more of spinner rollers 125 or V-rollers 127. In some embodiments, drill pipe 20' may be aligned longitudinally to a desired position within tubular handling cradle 123. In some such embodiments, positioning plate 119 of positioning carriage 117 may be extended into tubular handling cradle 123. Positioning carriage 117 may then travel along main skid frame 103, pushing drill pipe 20' into the desired position as depicted in FIG. 7 using positioning plate 119 against drill pipe 20'. In some embodiments, as depicted in FIG. 8, one or more tubular sensors 141 may be positioned to detect when drill pipe 20' is positioned in the desired position. In some embodiments, the desired position for drill pipe 20' may be selected such that drill pipe 20' is positioned to be engaged by pipe handler 15. In some embodiments, drill pipe 20' may be positioned relative to drilling rig 10 in a centered or other desired alignment.

Figure 9:
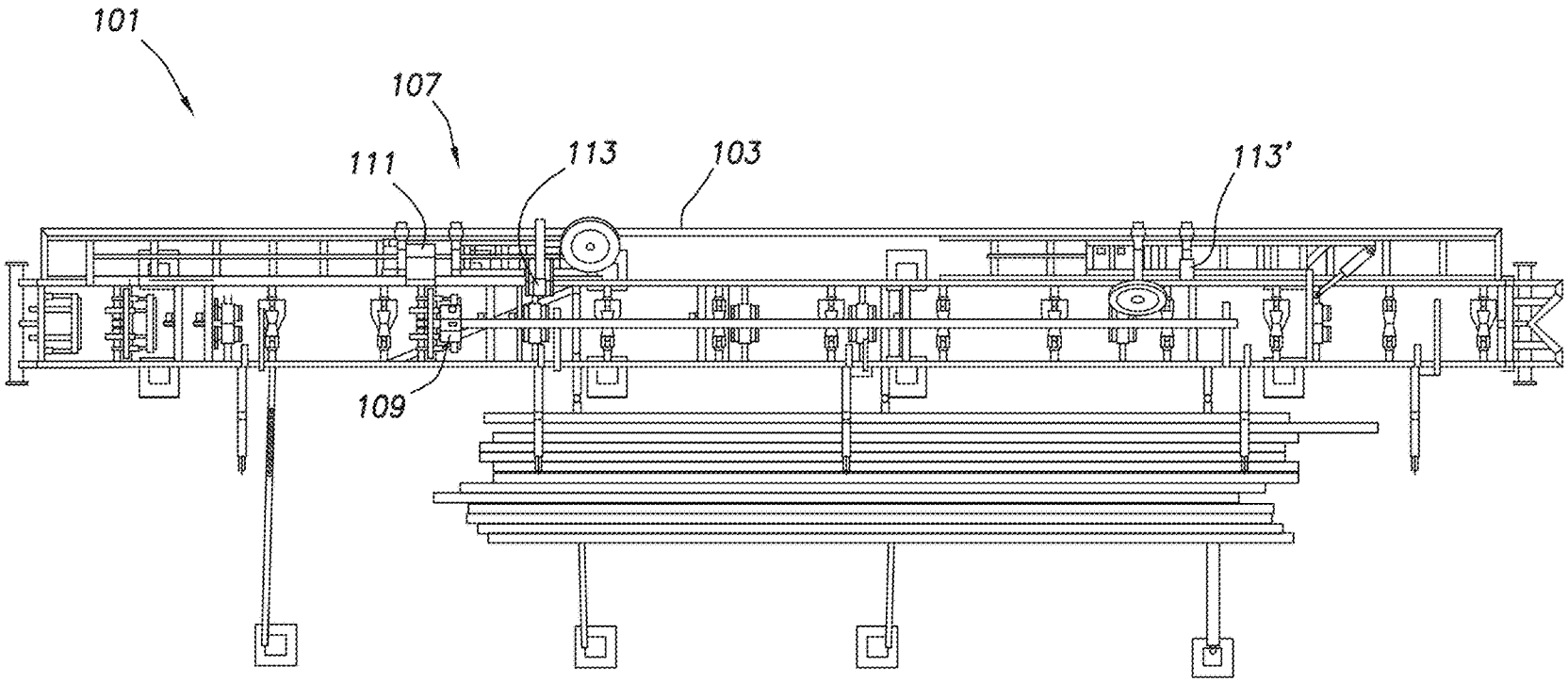
FIG. 9 depicts a top view of the main skid of FIG. 2.

Once in the desired position, pipe treatment carriage 107 may be traveled along main skid frame 103 into the pipe-treatment position as depicted in FIG. 9. In some embodiments, one or more of cleaning canister 109 and doping canister 111 may be pivoted into the treatment position. In some embodiments, one or both of roller clamps 113, 113' may be extended to engage drill pipe 20'.

Figure 10:
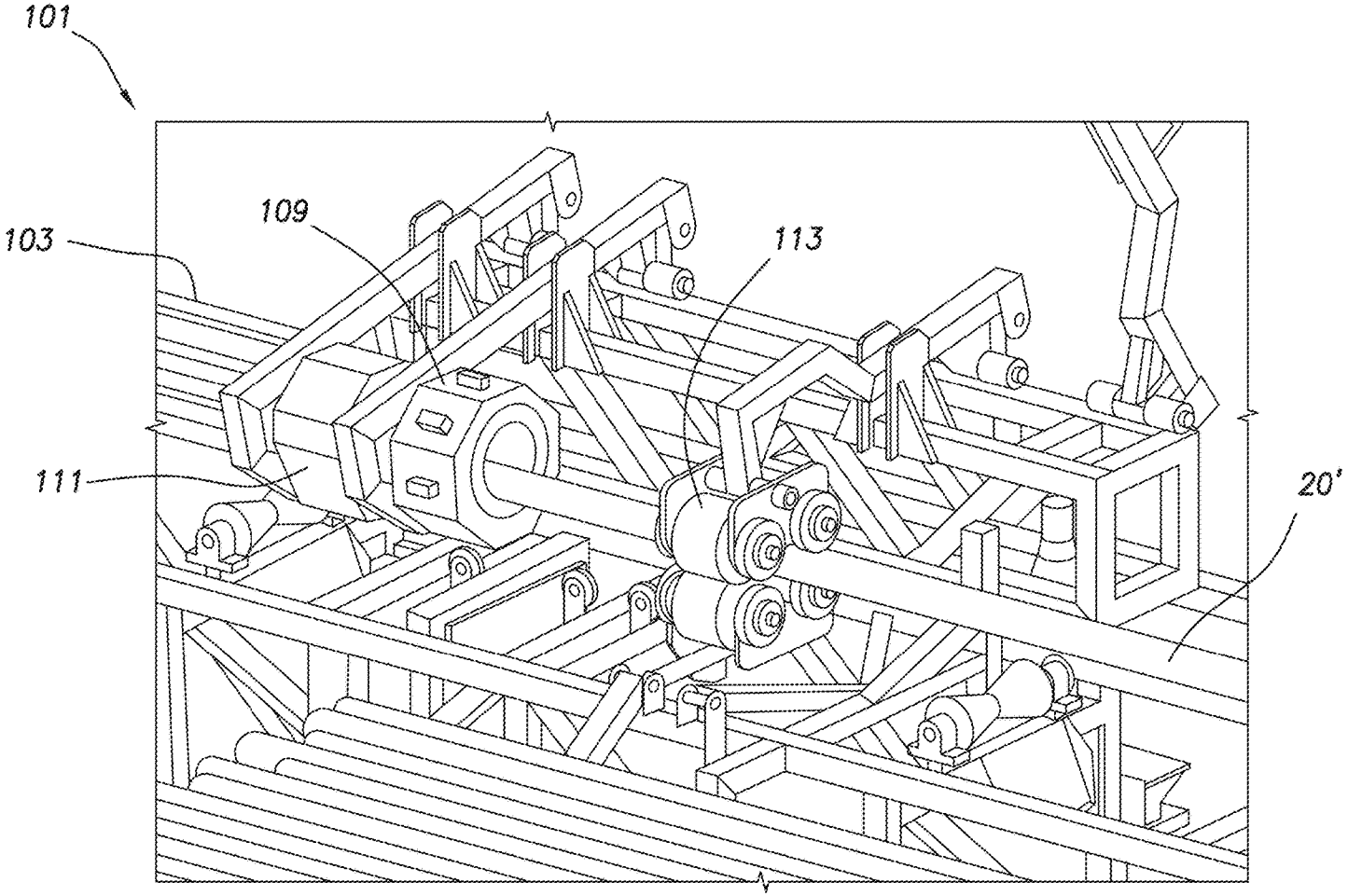
FIG. 10 depicts a perspective view of a pipe treatment carriage of the main skid of FIG. 2 consistent with at least one embodiment of the present disclosure.
Figure 11:
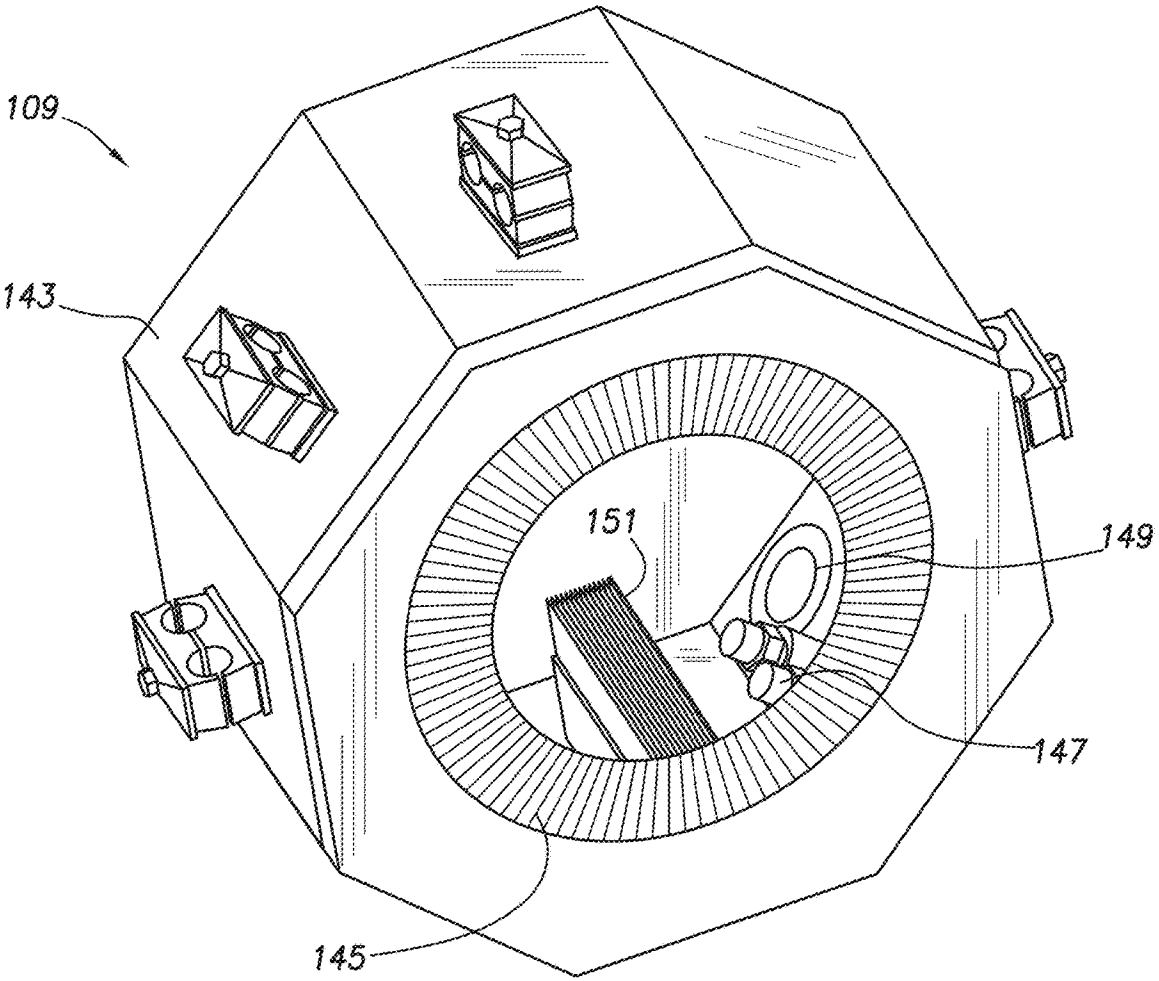
FIG. 11 depicts a perspective, partially-transparent view of a cleaning canister consistent with at least one embodiment of the present disclosure.

In some embodiments, as depicted in FIG. 10, roller clamp 113 may be extended to engage drill pipe 20'. In some embodiments, an end of drill pipe 20' may be positioned into cleaning canister 109. Cleaning canister 109 may, for example and without limitation, be used to clean the end of drill pipe 20'. Cleaning canister 109, as depicted in FIG. 11, may include a cleaning canister housing 143. In some embodiments, cleaning canister 109 may include one or more sensors to detect that cleaning canister 109 is correctly positioned to clean drill pipe 20'. Cleaning canister 109 may include one or more pieces of cleaning equipment. For example and without limitation, in some embodiments, cleaning canister 109 may include one or more of air nozzles 145, pressure water nozzles 147, or steam nozzles (not shown). In operation, one or more cleaning fluids such as, for example and without limitation, water, air, steam, or other cleaning liquid may be introduced against the end of drill pipe 20' at, in some embodiments, high pressure. In some embodiments, the cleaning fluid may be retained within cleaning canister housing 143. In some embodiments, cleaning canister housing 143 may include drain hole 149. In some embodiments, a vacuum drain hose (not shown) may be coupled to drain hole 149 to remove used cleaning fluid from cleaning canister housing 143. In some embodiments, a cleaning brush 151 may be coupled to cleaning canister housing 143 to, for example and without limitation, be used to mechanically clean the end of drill pipe 20'. In some embodiments, drill pipe 20' may be rotated by spinner rollers 125 or roller clamp 113 while positioned within cleaning canister housing 143. In some embodiments, pressurized air may be utilized to dry the end of drill pipe 20'.

Figure 12:
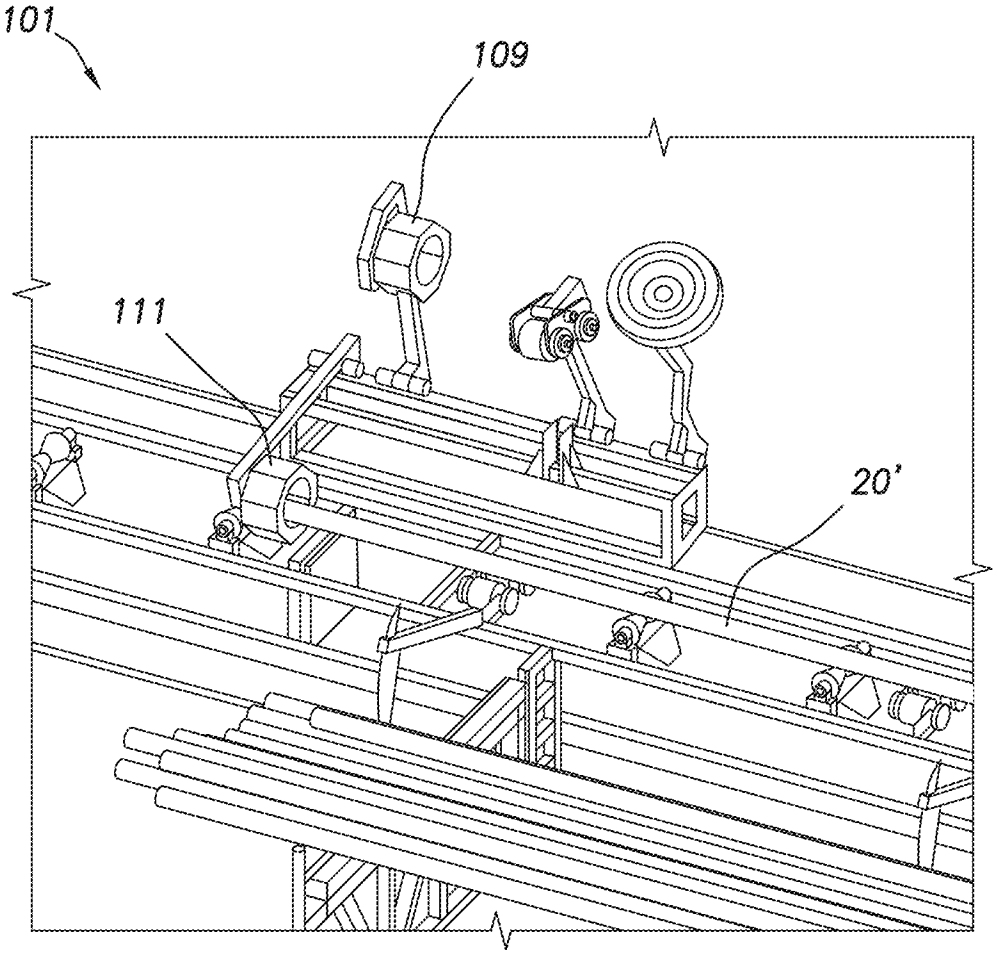
FIG. 12 depicts a perspective view of a pipe treating carriage of the main skid of FIG. 2 consistent with at least one embodiment of the present disclosure.
Figure 13:
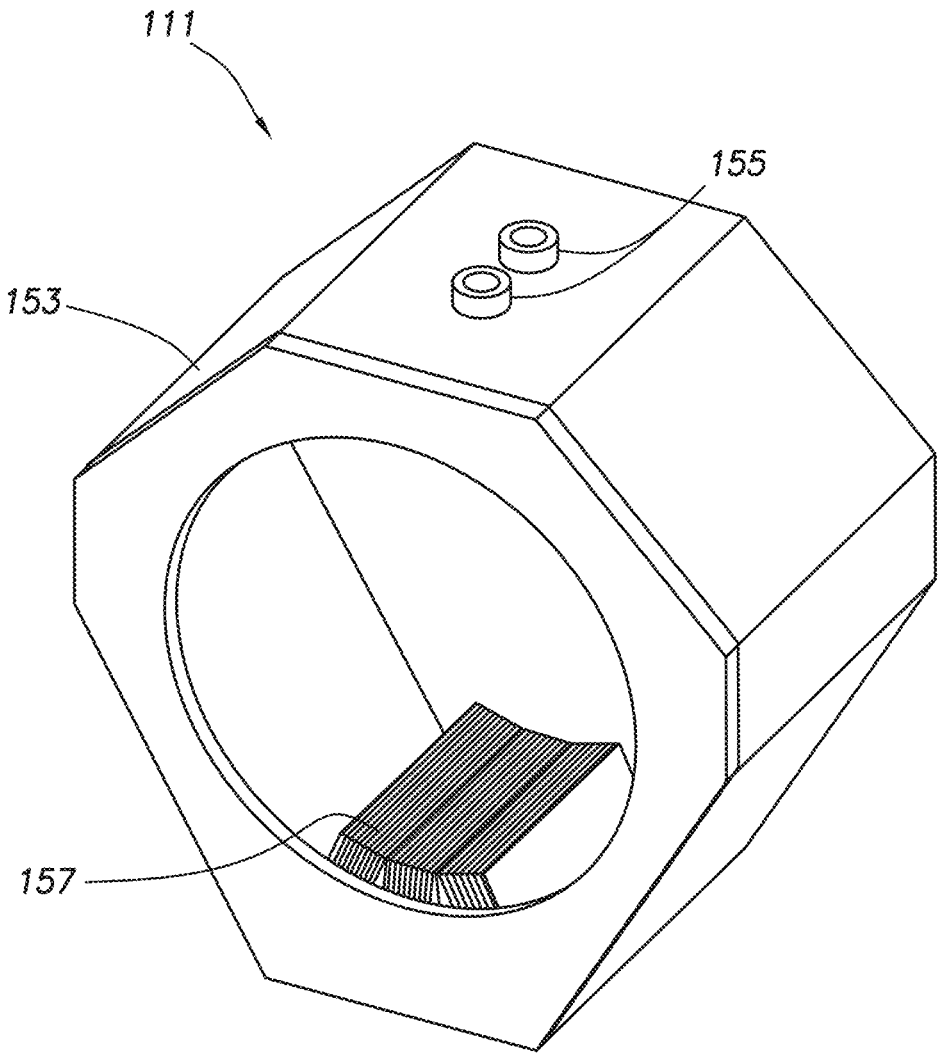
FIG. 13 depicts a perspective view of a doping canister consistent with at least one embodiment of the present disclosure.

In some embodiments, once drill pipe 20' has been cleaned, cleaning canister 109 may be retracted as depicted in FIG. 12 and doping canister 111 may be repositioned about the end of drill pipe 20'. Once in position, pipe dope may be applied to the end of drill pipe 20'. In some embodiments, as depicted in FIG. 13, doping canister 111 may include a doping canister housing 153. Doping canister housing 153 may include one or more dope injectors 155 used to introduce pipe dope onto the end of drill pipe 20'. In some embodiments, dope injectors 155 may be positioned at an upper side of doping canister housing 153 such that pipe dope is applied onto a box or pin coupler of a tool joint at the end of drill pipe 20'. In some embodiments, doping canister 111 may include a dope brush 157 positioned to help coat the outer surface of the end of drill pipe 20'. Drill pipe 20' may be rotated by spinner rollers 125 or roller clamp 113 while positioned within doping canister 111 to help coat the outer surface of the end of drill pipe 20'.

Figure 14:
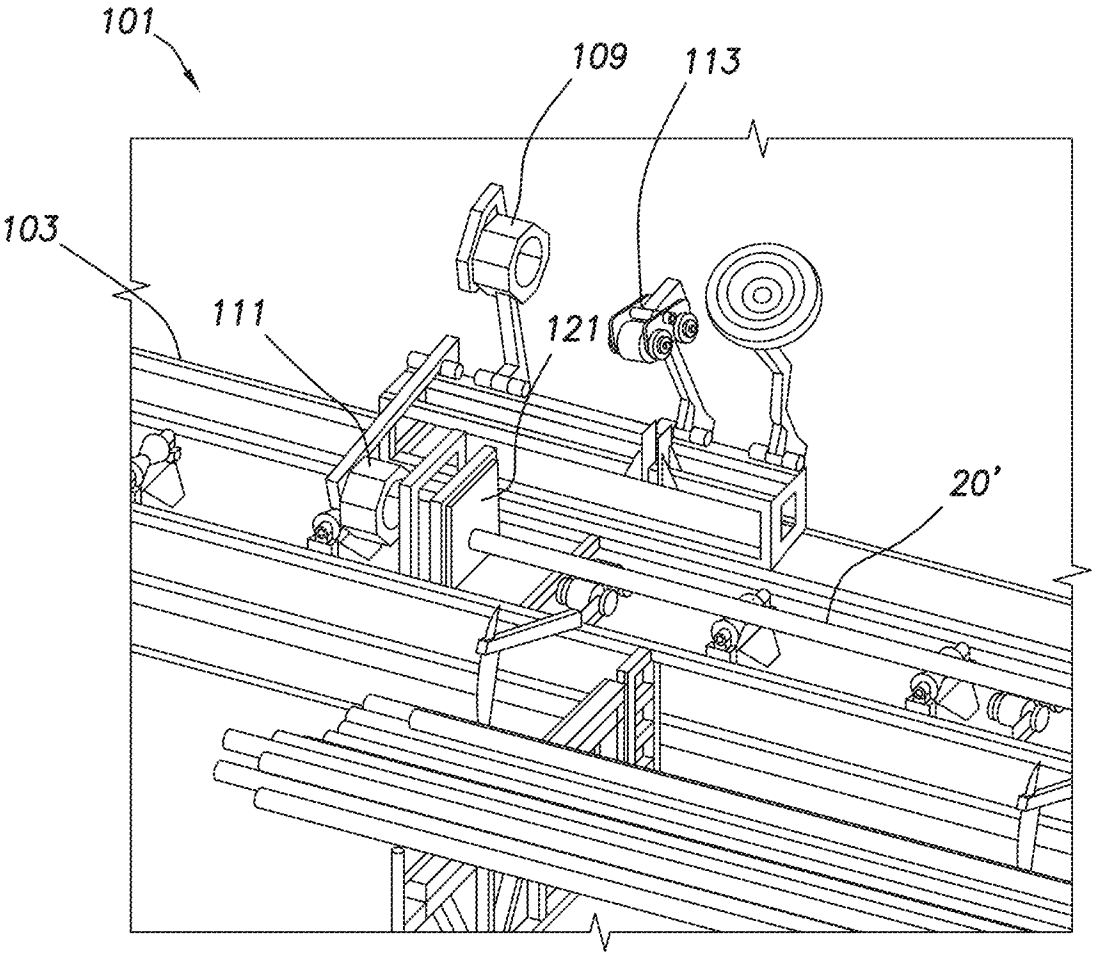
FIG. 14 depicts a perspective view of a pipe treating carriage of the main skid of FIG. 2 consistent with at least one embodiment of the present disclosure.

Once drill pipe 20' is cleaned and doped, doping canister 111 and pipe treatment carriage 107 may be moved away from drill pipe 20' as depicted in FIG. 14. In some embodiments, measurement plate 121 may be positioned into tubular handling cradle 123 proximate the end of drill pipe 20'. Measurement plate 121 may, in some embodiments, be extended or retracted vertically relative to main skid frame 103. In some embodiments, measurement plate 121 may include one or more sensors to detect contact with drill pipe 20' as it is urged toward it by positioning plate 119 of positioning carriage 117. Measurement plate 121 may so be used to determine an actual length of drill pipe 20', position drill pipe 20' within tubular handling cradle 123, and count the number of drill pipes 20 supplied to pipe handler 15. Drill pipe 20' may then be engaged by pipe handler 15 as depicted in FIG. 1 and introduced into drilling rig 10.

In some embodiments, although not depicted, positioning carriage 117 may include one or more of a cleaning canister or doping canister to clean and/or dope the other end of drill pipe 20'. In some embodiments, the cleaning canister and doping canister may be combined into a single cleaning/doping canister.

In some embodiments, ground handling system 100 may include main skid 101 as described herein above alone. In some embodiments, ground handling system 100 may further include one or more secondary skids 201. For the purposes of this disclosure, a single secondary skid 201 is discussed, but one having ordinary skill in the art with the benefit of this disclosure will understand that any number of secondary skids 201 may be utilized with ground handling system 100.

Figure 15:
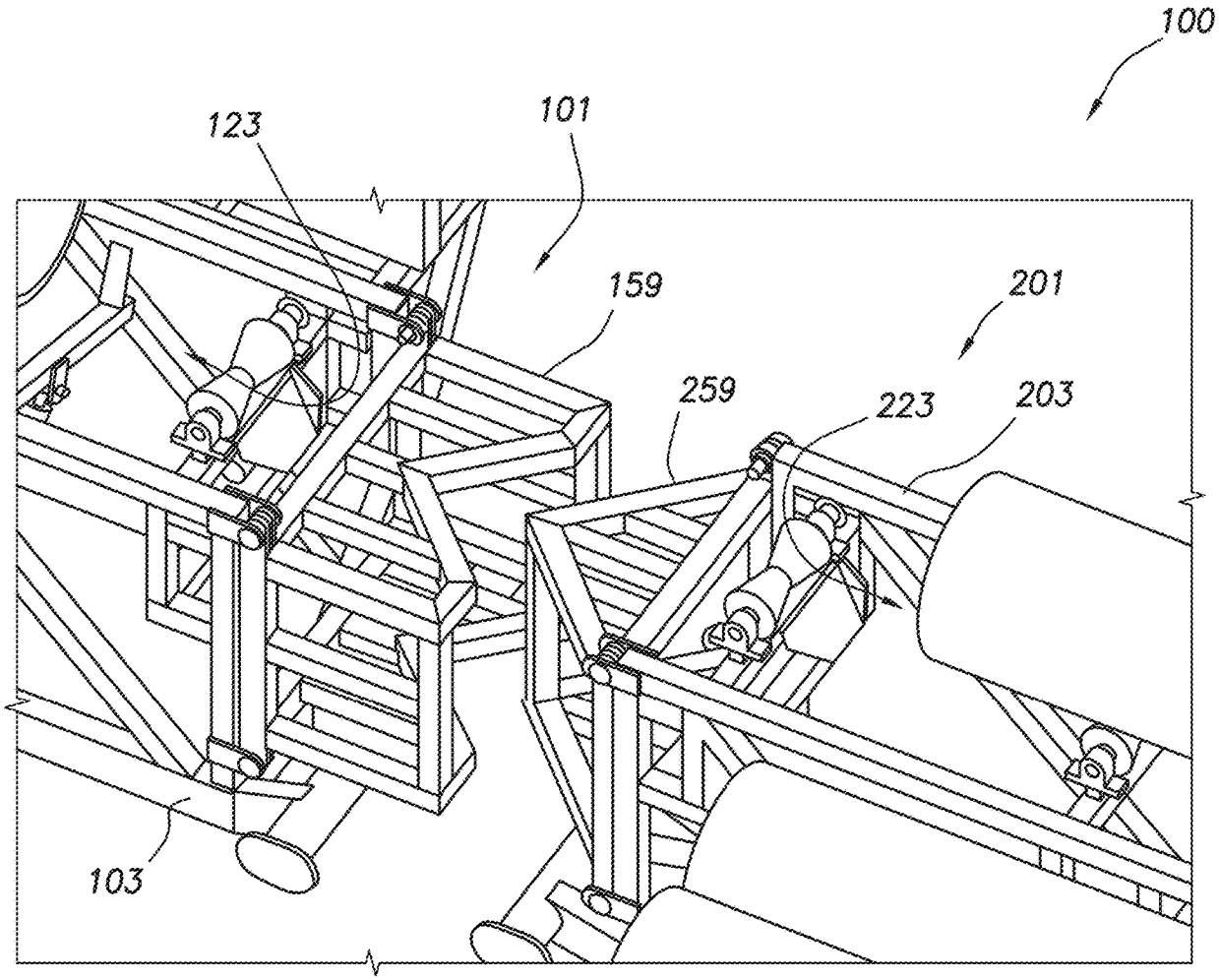
FIG. 15 depicts a perspective view of a coupler between a main skid and a secondary skid consistent with at least one embodiment of the present disclosure

Secondary skid 201, may be positioned at an end of main skid 101. In some embodiments, secondary skid 201 may be mechanically coupled to main skid 101. For example, in some such embodiments, as depicted in FIG. 15, main skid 101 may include a female coupler 159 coupled to main skid frame 103. Female coupler 159 may engage with a male coupler 259 coupled to secondary skid frame 203. In some embodiments, female coupler 159 may engage male coupler 259 such that tubular handling cradle 123 of main skid 101 is substantially aligned with tubular handling cradle 223 of secondary skid 201. In some embodiments, female coupler 159 may instead be coupled to secondary skid 201 and male coupler 259 may be coupled to main skid 101 without deviating from the scope of this disclosure.

Figure 16:
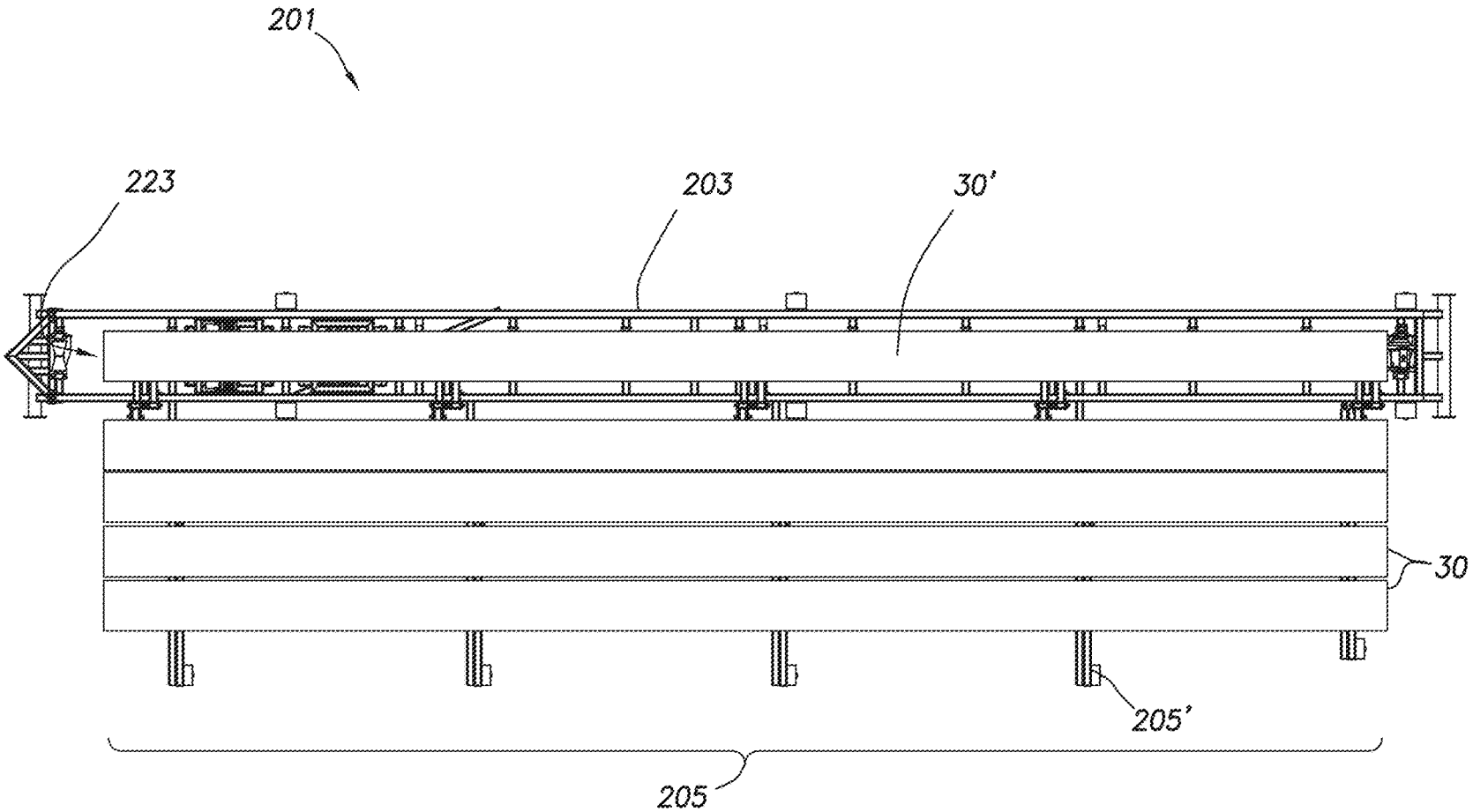
FIG. 16 depicts a top view of a secondary skid consistent with at least one embodiment of the present disclosure.

In some embodiments, as depicted in FIG. 16, secondary skid 201 may include a secondary skid frame 203 and a secondary catwalk 205. Secondary catwalk 205 may be used to support horizontally positioned tubular members for storage prior to introduction into drilling rig 10, depicted in FIG. 16 as casing segment 30. Secondary catwalk 205 may, in some embodiments, be made up of one or more separate catwalk segments 205' that may, in some embodiments, pivotably couple to secondary skid frame 203.

In some embodiments, casing segments 30 positioned on secondary catwalk 205 may be introduced into a tubular handling cradle 223 positioned on secondary skid frame 203. In some embodiments, tubular handling cradle 223 may include one or more V-rollers 227. In some embodiments, one or more of V-rollers, conveyor belts, rollers, chain systems, or rack and pinion systems may be used to move or allow casing segments 30 to be moved longitudinally within tubular handling cradle 223.

Figure 17:
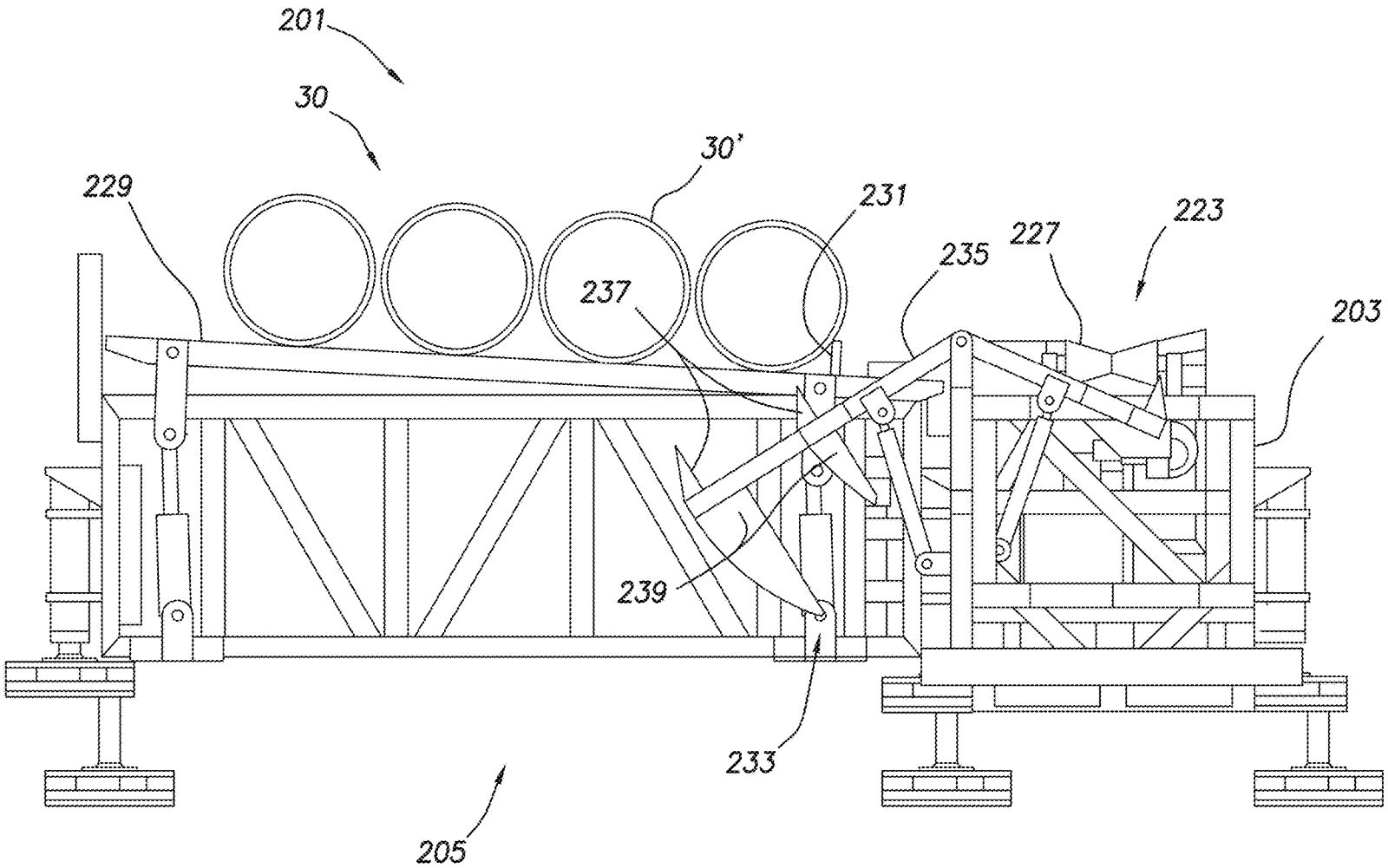
FIGS. 17-19 depict end views of the secondary skid of FIG. 15.
Figure 18:
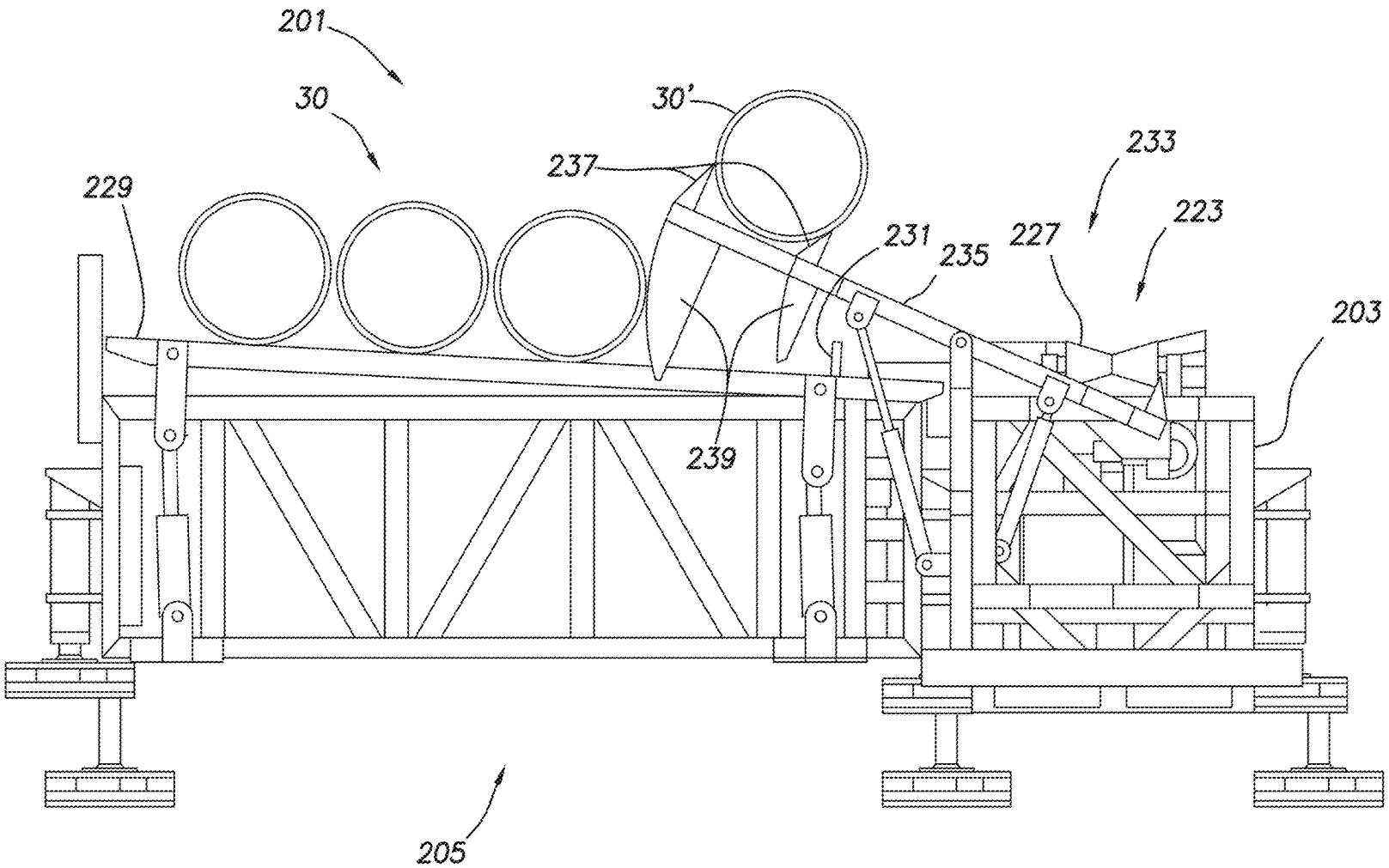
Figure 19:
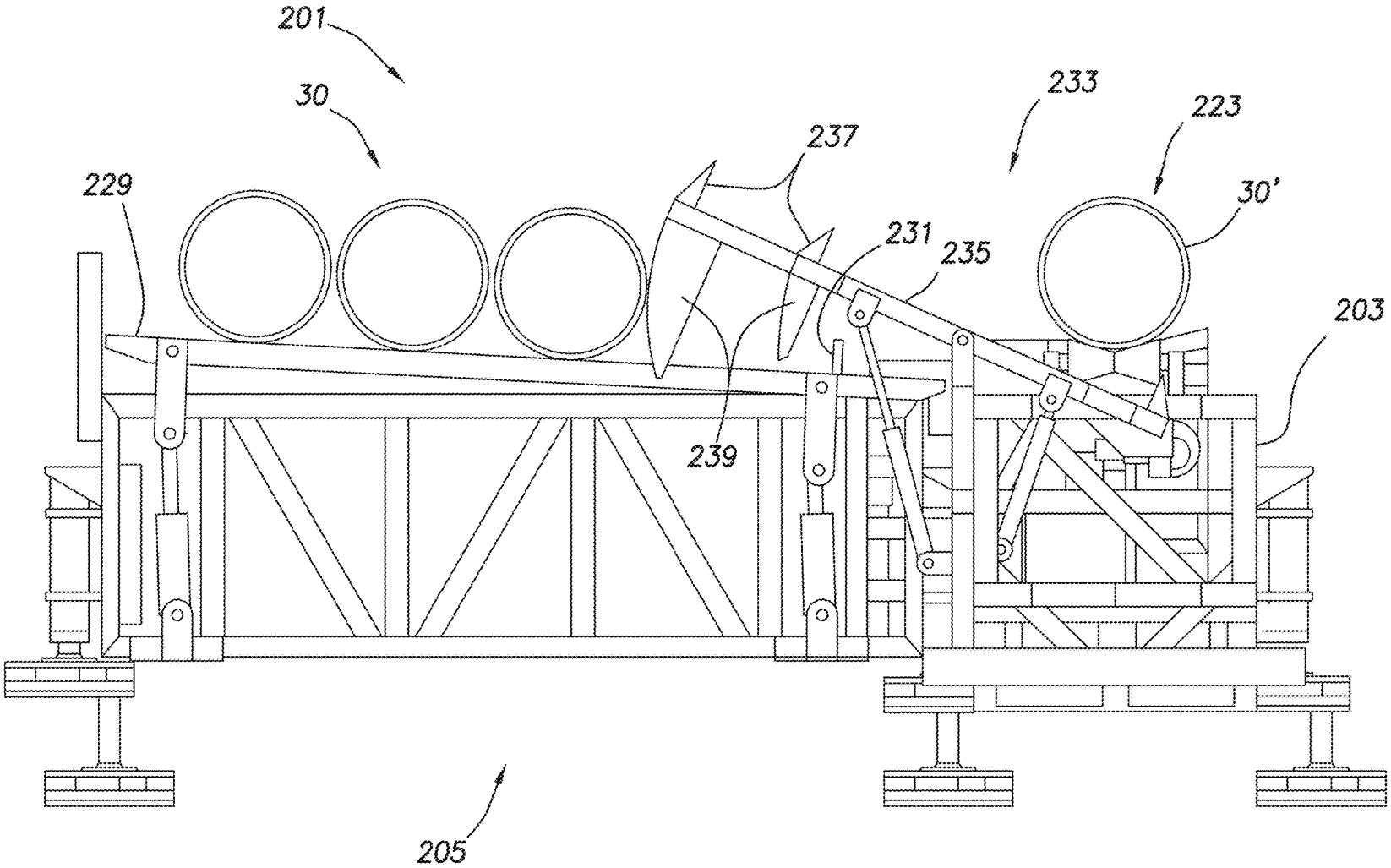

As depicted in FIGS. 17-19, multiple lengths of casing segment 30 may be positioned on secondary catwalk 205 in a horizontal configuration for, for example and without limitation, storage prior to introduction to drilling rig 10. In some embodiments, casing segments 30 may be positioned atop a storage rail 229. Storage rail 229 may, in some embodiments, be at an angle such that casing segments 30 positioned thereon are biased by gravity or actuated toward secondary skid frame 203. In some embodiments, storage rail 229 may be coupled to secondary catwalk 205 such that the angle of storage rail 229 may be modified or actuated to tilt. In some embodiments, secondary catwalk 205 may include a stop rail 231. Stop rail 231 may prevent casing segment 30 from rolling into tubular handling cradle 223. In some embodiments, stop rail 231 may be repositionable to, for example and without limitation, accommodate different sizes or configurations of casing segments 30 or other tubulars.

In some embodiments, individual lengths of casing segment 30 may be loaded into tubular handling cradle 223 from secondary catwalk 205 by one or more indexers 233. Indexers 233 may be pivotably coupled to secondary skid frame 203. Indexers 233 may include transfer rail 235, separators 237, and stoppers 239. In some embodiments, multiple indexers 233 may be included having configurations intended for use with different tubular members, such as casing segment 30.

In an indexing operation, indexers 233 may be pivoted upward from the home position depicted in FIG. 17 to a raised position as depicted in FIG. 18. As indexers 233 raise, separators 237 separate the tubular member closest to tubular handling cradle 223 (here depicted as casing segment 30') from any remaining casing segment 30 on secondary catwalk 205. At the same time, stoppers 239 may prevent the rest of casing segment 30 from rolling against stop rail 231. Casing segment 30', now positioned on transfer rail 235, may roll along the inclined transfer rail 235 into tubular handling cradle 223 as depicted in FIG. 19. Indexers 233 may then be lowered to the home position, allowing the next tubular member to roll up to stop rail 231 for the next indexing operation.

Figure 20:
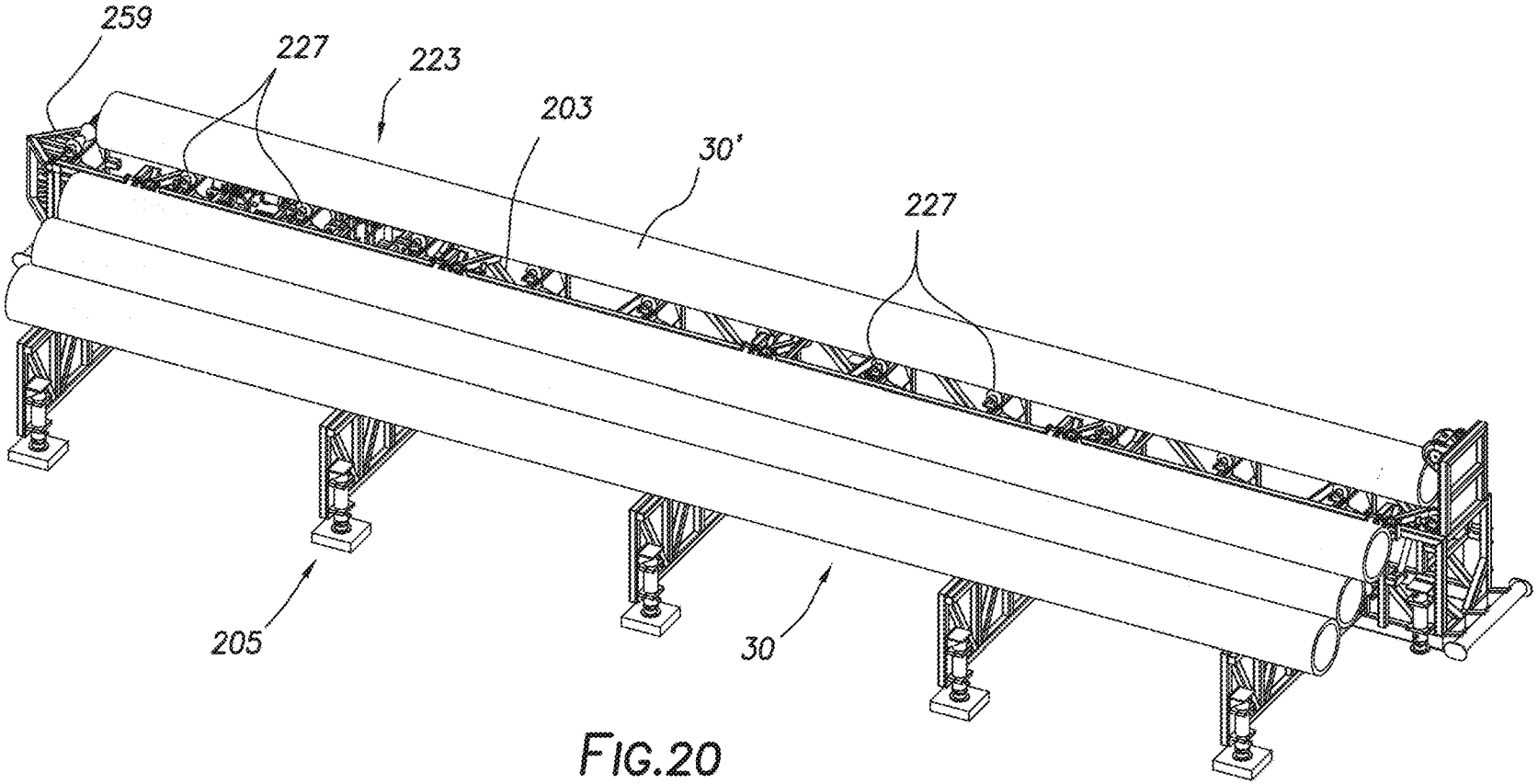
FIG. 20 depicts a perspective view of the secondary skid of FIG. 15.
Figure 21:
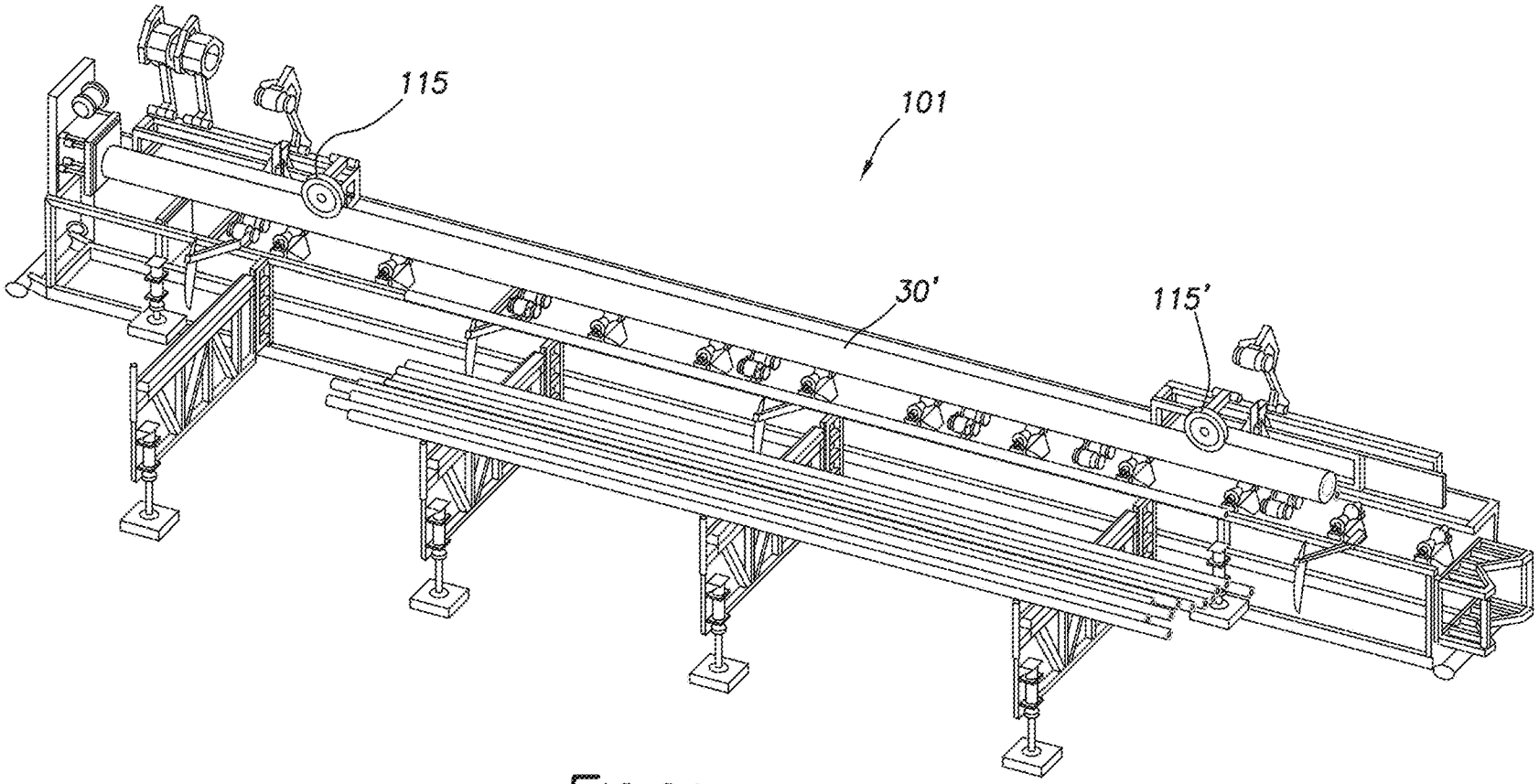
FIG. 21 depicts a perspective view of a main skid consistent with at least one embodiment of the present disclosure.

Once casing segment 30' is positioned in tubular handling cradle 223 as depicted in FIG. 20, casing segment 30' may be supported by V-rollers 227. In some embodiments, one or more V-rollers 227 may be powered to, for example and without limitation, move casing segment 30' from secondary skid 201 to main skid 101 as depicted in FIG. 21 to be handled as discussed herein above with respect to drill pipe 20'. In some embodiments, one or both of tire clamps 115, 115' may be used to slow casing segment 30' as it is introduced into main skid 101.

Figure 22:
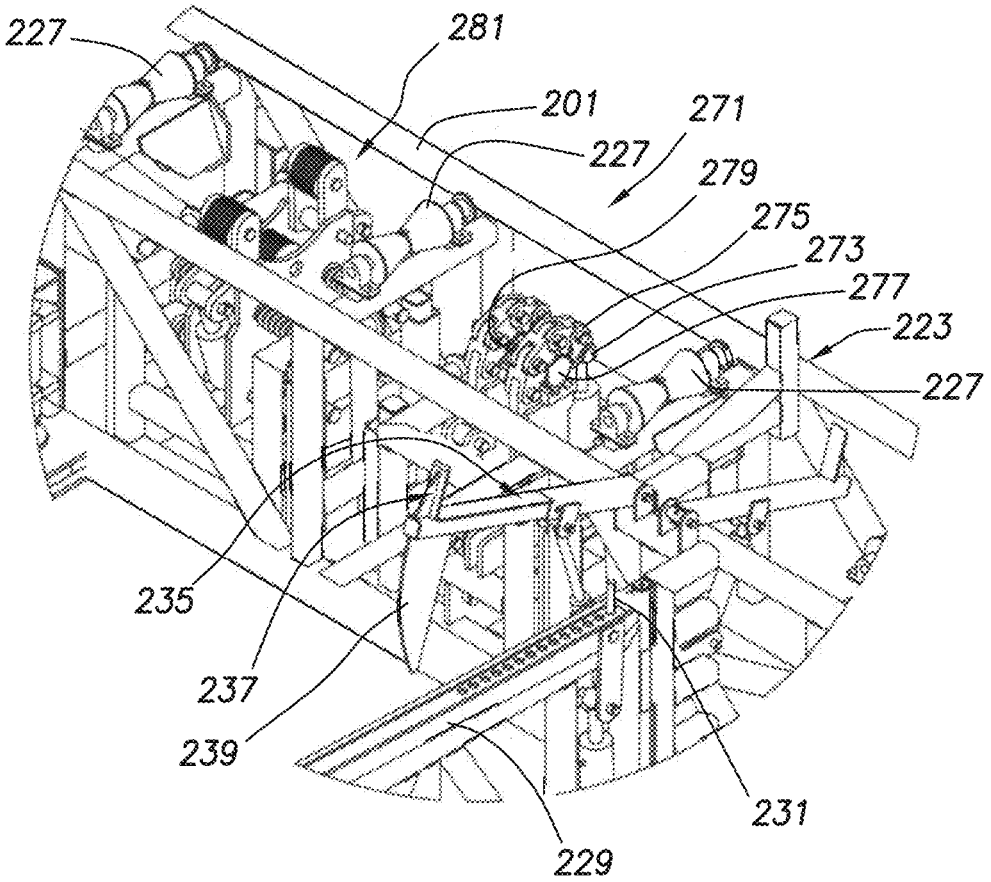
FIG. 22 depicts a perspective view of a bucking unit of a secondary skid consistent with at least one embodiment of the present disclosure.

In some embodiments, as depicted in FIG. 22, secondary skid 201 may include a bucking unit 271. Bucking unit 271 may be used to, for example and without limitation, mechanically couple one or more sections of tubular such as drill pipe 20 or casing segment 30 as previously discussed to one or more additional pieces of equipment. For example, in some embodiments, a spacer, sub, centralizer, stabilizer, collar, or other tool may be threadedly coupled to an end of drill pipe 20 or casing segment 30 by bucking unit 271.

In some embodiments, bucking unit 271 may by positioned within tubular handling cradle 223 of secondary skid 201. Bucking unit 271 may include one or more pipe tongs, here depicted as fixed pipe tong 273 and rotating pipe tong 275. In some embodiments, fixed pipe tong 273 and rotating pipe tong 275 may include one or more fixed clamp jaws 277 and rotating clamp jaws 279 respectively to mechanically couple to a length of drill pipe 20, casing segment 30, or other tubular component. Rotating pipe tong 275 may rotate the piece of drill pipe 20, casing segment 30, or other tubular component relative to the piece of drill pipe 20, casing segment 30, or other tubular component coupled to fixed pipe tong 273. In some embodiments, bucking unit 271 may include pipe spinner 281. Pipe spinner 281 may rotate a piece of drill pipe 20, casing segment 30, or other tubular component positioned therein relative to the piece of drill pipe 20, casing segment 30, or other tubular component held by fixed pipe tong 273. In some embodiments, pipe spinner 281 may rotate at a high speed but at low torque, and rotating pipe tong 275 may rotate at a low speed but with high torque in order to make up the threaded connection. In some embodiments, one or more components of bucking unit 271 may be retractable into secondary skid 201 and out of tubular handling cradle 223 to, for example and without limitation, allow movement of drill pipe 20, casing segment 30, or other tubular component as discussed herein above.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

What is claimed is:

1. A ground handling system for tubulars, comprising:
- a main skid, the main skid including:
  - a main skid frame, the main skid frame including a first tubular handling cradle; and
  - a first catwalk, the catwalk mechanically coupled to the main skid frame; and
- a secondary skid, the secondary skid mechanically coupled to the main skid, the secondary skid including:
  - a secondary skid frame, the secondary skid frame including a second tubular handling cradle;
  - a secondary catwalk, the secondary catwalk mechanically coupled to the secondary skid frame; and
  - a positioning carriage, the positioning carriage slidably coupled to the main skid frame
  - wherein the first tubular handling cradle is substantially aligned with the second tubular handling cradle; and
  - wherein the positioning carriage comprises a positioning plate, one or more of a roller clamp or tire clamp, or a measurement plate.

2. The ground handling system of claim 1, further including means for moving a tubular from the secondary skid to the main skid.

3. The ground handling system of claim 1 wherein the main skid further comprises a pipe treatment carriage, the pipe treatment carriage slidably coupled to the main skid frame.

4. The ground handling system of claim 3 wherein the pipe treatment carriage includes one or more of a cleaning canister, doping canister, roller clamp, or tire clamp.

5. The ground handling system of claim 4 wherein the cleaning canister comprises a cleaning canister housing, a drain port, and at least one cleaning fluid nozzle.

6. The ground handling system of claim 5 wherein the cleaning canister comprises a brush.

7. The ground handling system of claim 4 wherein the doping canister comprises a doping canister housing and a pipe dope nozzle.

8. The ground handling system of claim 1 wherein the main skid and the secondary skid each further comprise one or more V-rollers, conveyor belts, rollers, chain systems, or rack and pinion systems.

9. The ground handling system of claim 1 wherein the main skid further comprises one or more spinner rollers.

10. The ground handling system of claim 1 wherein the first catwalk and secondary catwalk are each made up of one or more catwalk segments.

11. The ground handling system of claim 1 wherein the catwalk and secondary catwalk each comprises a storage rail, a stop rail, and at least one indexer, the indexer adapted to introduce a single tubular member into the tubular handling cradle at each indexing operation.

12. The ground handling system of claim 1, further comprising a bucking unit mechanically coupled to the second skid, the bucking unit including a fixed pipe tong, a rotating pipe tong, and a pipe spinner.

13. A method comprising:

a) providing a ground handling system including:

a main skid, the main skid including:

a main skid frame, the main skid frame including a main tubular handling cradle;

a main catwalk, the main catwalk mechanically coupled to the main skid frame; and a measurement plate; and a secondary skid, the secondary skid mechanically coupled to the main skid, the secondary skid including:

a secondary skid frame, the secondary skid frame including a secondary tubular handling cradle; and a secondary catwalk, the secondary catwalk mechanically coupled to the secondary skid frame;

b) positioning one or more tubular members on the main catwalk;

c) transferring a first tubular member from the main catwalk to the main tubular handling cradle; and d) determining a length of the first tubular member.

14. The method of claim 13, further comprising:

e) positioning a second tubular member on the secondary catwalk;

f) transferring the second tubular member from the secondary catwalk to the secondary tubular handling cradle; and g) transferring the second tubular member from the secondary tubular handling cradle to the main tubular handling cradle.

15. The method of claim 13 wherein the main skid and the secondary skid each further comprises one or more V-rollers, conveyor belts, rollers, chain systems, or rack and pinion systems.

16. The method of claim 13 wherein the secondary skid further comprises a bucking unit, the bucking unit including a fixed tong and a rotating tong, and the method further comprises:

mechanically coupling the second tubular member to a third tubular member or tool with the fixed tong and rotating tong.

17. The method of claim 16 wherein the bucking unit further comprises a pipe spinner.

18. The method of claim 13 wherein the main skid further comprises a pipe treatment carriage, the pipe treatment carriage including one or more of a cleaning canister or doping canister, and the method further comprises:

cleaning an end of the first tubular member with the cleaning canister; and doping the end of the first tubular member with the doping canister.

19. The method of claim 13 wherein the main skid further comprises one or more spinner rollers, and the method further comprises rotating the first tubular member within the main tubular handling cradle.

20. The method of claim 13 wherein the catwalk and secondary catwalk each comprises a storage rail, a stop rail, and at least one indexer, and the method further comprises introducing, with the indexer, a single tubular member into the tubular handling cradle at each indexing operation.

* * * * *